United States Patent [19]

Green, Jr.

[11] Patent Number: 4,562,687

[45] Date of Patent: Jan. 7, 1986

[54] TRAY CARTON END PANEL FOLDING AND SEALING ASSEMBLY

[75] Inventor: James B. P. Green, Jr., West Monroe, La.

[73] Assignee: Southern Tool Company, West Monroe, La.

[21] Appl. No.: 501,951

[22] Filed: Jun. 7, 1983

[51] Int. Cl.[4] ..... B65B 49/12

[52] U.S. Cl. ..... 53/383; 53/374; 493/142; 493/151; 493/183

[58] Field of Search ..... 53/383, 374, 375; 493/142, 183, 453, 151

[56] References Cited

U.S. PATENT DOCUMENTS

| | | | |
|---|---|---|---|
| 2,268,423 | 12/1941 | Rose | 53/374 X |
| 3,504,478 | 4/1970 | Dieter | 53/209 X |
| 4,034,658 | 7/1977 | Sherman | 493/181 X |
| 4,460,349 | 7/1984 | Charron | 493/142 X |

*Primary Examiner*—James F. Coan

*Attorney, Agent, or Firm*—Bachman & LaPointe

[57] ABSTRACT

In a machine for erecting tray cartons about one or more articles such as pairs of twelve pack beverage cartons, an end panel folding and sealing assembly is provided with folding plates that move with the tray carton in the downstream direction as the plates fold and hold the tray end panels against the tray end flaps while the glue sets to adhesively bond the end panels and flaps together.

4 Claims, 13 Drawing Figures

14
16
18
20
22
24
26
28
30

TRAY CARTON END PANEL FOLDING AND SEALING ASSEMBLY

BACKGROUND OF THE INVENTION

This invention relates to a tray carton erecting machine and, more particularly, to an end panel folding and sealing apparatus which seals the end panels and end flaps of the tray cartons together to complete the erection of the tray carton from its blank.

Tray carton machines which erect tray blanks about articles to be packaged in the tray cartons are used extensively in the soft drink and beer industry to package either sets of individual beverage cans, or pair of twelve-pack cartons. These tray carton machines typcally package up to 100 cartons per minute and normally employ static folding bars for folding the end panels of the trays against the end flaps and holding them together while the glue previously applied between the end flaps and panels sets. Some of these machines, such as the one disclosed in U.S. Pat. No. 3,504,478 also employ an auxiliary end panel sealer which is actuated when the machine is shut down to complete the folding and sealing of the end panels and flaps of the tray carton then in the folding and sealing station.

Tray carton machines which employ the static folding bars encounter a problem. The static bars which both fold and press the end panels against the end flaps to complete the formation of the trays exert a drag on the end panels. This causes at least some of the tray cartons to be formed such that the end panels do not line up properly with the end flaps and side panels. The tray cartons are out of square. This problem is not only aesthetic but the projecting portions of the panels can catch on other trays or objects and the handling of these trays can be a problem.

Tray carton machines such as the one disclosed in U.S. Pat. No. 3,504,478 which utilize an auxiliary end panel sealer that is pneumatically operated can present additional problems. If the pneumatic system malfunctions the tray then in the folding and sealing station will not be sealed. If the problem is observed the tray can be removed from the machine. Otherwise the tray carton comes apart after being discharged from the machine.

The tray carton machine of the present invention is provided with a unique end panel folding and tray sealing assembly. The static end panel folding bar and the need for an auxliary end flap sealer is eliminated by the mechanism of the present invention.

The mechanism for folding the tray end panels and pressing the end panels against the tray end flaps includes a pair of folding plates mounted within the folding and sealing station adjacent to and on opposite sides of the tray conveyor. Each folding plate is rotatably attached at its lower ends of crank arms of a pair of cranks. The cranks are spaced from each other with one crank being located a distance downstream from the other crank, less than the length of the folding plate. The crank arms of the cranks extend parallel to each other and are equal in length. Thus as the cranks are rotated in unison, the folding plates, which are in contact with the tray end panels during the upper half of their cycles, move in the downstream direction as the plates are being raised and lowered to fold the end panels and press the end panels against the end flaps. The downstream movement of the folding plates during the folding of the end panels and the sealing of the tray substantially eliminates or reduces drag by the folding plates on the end panels. Thus the tray carton machine of the present invention can form trays which are insquare and at speeds of over 100 cartons per minute.

Another advantage of the present invention is the elimination of an auxiliary end panel folding mechanism. The crank mechanisms are driven by drive trains which not only synchronize the cycles of the folding plates with the movement of the tray conveyor but also stop the folding plates at the uppermost point of their cycles under a normal shutdown. The end panels of the tray in the station are pressed and held against the end flaps to seal the tray and no auxiliary mechanism or pneumatic controls are required to effect the sealing operation.

BRIEF DESCRIPTION OF THE DRAWINGS

Other objectives and advantages of the present invention will be more apparent from the following detailed description taken in conjunction with the accompanying drawings wherein.

DETAILED DESCRIPTION OF THE INVENTION

Figure 1:
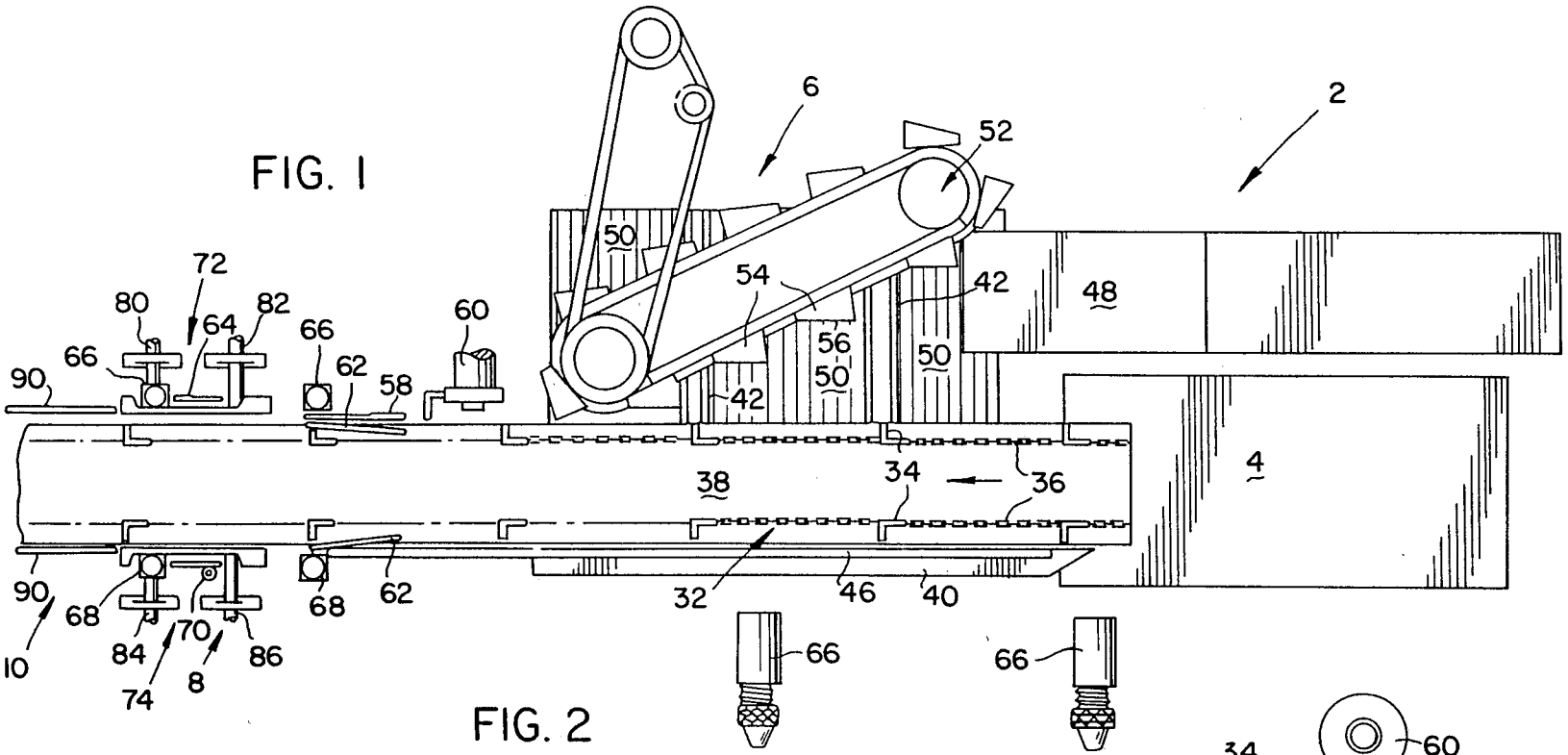
FIG. 1 is a schematic plan view of a tray carton machine using the present invention.

The schematic plan view of the tray carton machine 2 illustrates the typical stations of such a machine. The tray carton machine 2 includes a tray blank hopper and feed system 4, an article loading station 6, a gluing and sealing station 8 and a discharge station 10 where the trays with the articles packaged therein are removed for storage or shipment.

Each tray carton 12 includes a bottom panel 14, a pair of side panels 16 and 18, a pair of end panels 20, 22 and end flaps 24, 26, 28 and 30. The side panels and end panels are hingedly joined to the bottom panel along score lines and the end flaps are hingedly joined to the ends of the side panels along score lines.

A tray carton conveyor 32 comprising pairs of tray carrier lugs 34 joined by drive chains 36 extends from the tray blank hopper and feed system 4 through the discharge station 10. As the pairs of lugs 34 travel downstream through the machine carrying the tray cartons 12, the lugs travel over and adjacent the lateral edges of a bed plate 38 which also extends from the tray blank hopper and feed system 4 through the discharge station 10. The adjacent lugs 34 are spaced a distance equal to the width of the tray cartons 12 which they transport through the machine.

The tray blank hopper and feed system 4 can be one of several such systems known in the art such as the tray feed system disclosed in U.S. Pat. No. 4,034,658, the disclosure of which is hereby incorporated by reference. The function of the tray hopper and feed system is to supply tray blanks to the conveyor 32 so that the tray blanks can be erected, loaded and sealed into tray cartons.

Figures 9, 10, 11, 12, 13:
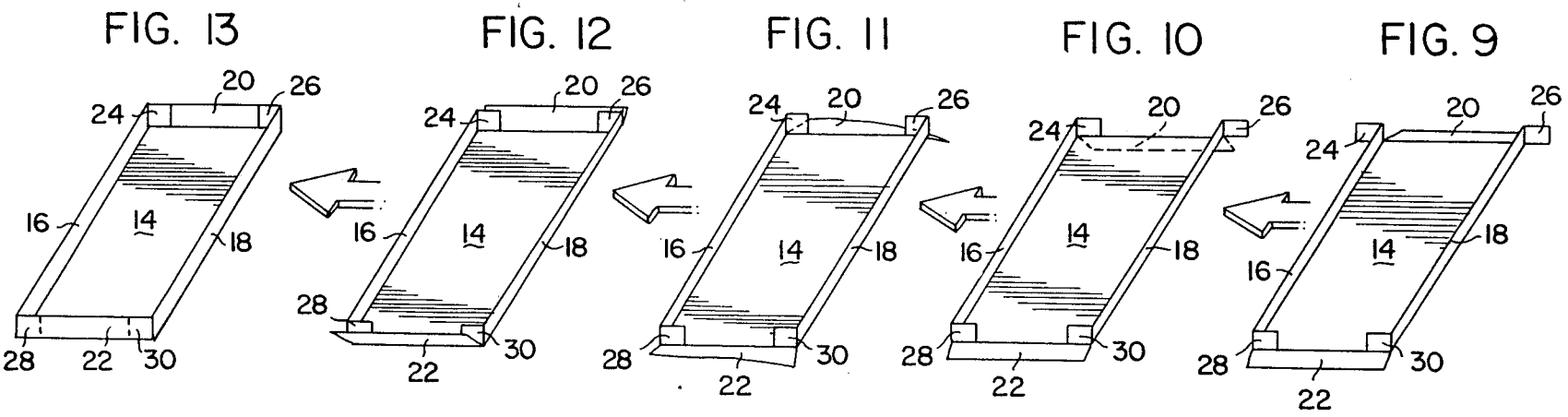
FIGS. 9–13 are schematic views illustrating the steps of completing the formation of a tray carton after it has been loaded with articles.

As the tray blanks are loaded onto the tray carton conveyor 32, the tray blanks are partially erected as shown in FIG. 9 for the loading operation by conventional folding bars and tucking fingers normally used for such operations. The end panels 20 and 22 are erected and held upright by the lugs 34. The end panels are disposed under the fold down bars 40 (only one is shown) which extend from the tray hopper and feed system through the loading station. The fold down bars 40 are mounted on opposite sides of the bed plate 38 below the horizontal plane of the bed plate. The bars 40 are adjacent to but spaced laterally from the bed plate and are inclined downward and outward to hold the end panels down. The end flaps 24 and 26 on the loading side of the tray carton are folded outward to extend away from each other and held in that position between lugs 34 and the raised bars 42 of the basket chain conveyor 44. The end flaps 28 and 30 on the opposite side of the tray carton are folded inward toward each other and held in that position by flap retaining rod 46. The flap retaining rod extends from the tray hopper and feed system to the gluing and sealing station. The rod is mounted adjacent the side of the bed plate 38 at a height about half the height of the end flaps above the horizontal plane of the bed plate 38.

The articles to be packaged in the tray cartons are loaded into the partially erected cartons at the article loading statin 6. The articles to be packaged are supplied to the loading station 6 by an infeed conveyor 48. The articles to be packaged in the tray carton typically comprise one of the following: twenty-four individual cans, four six-packs of cans or bottles, or two twelve-packs of cans or bottles.

The infeed conveyor delivers the articles to be packaged onto the basket chain conveyor 44. The basket chain conveyor 44 is located adjacent, runs parallel to, and at the same speed as the main conveyor 32. The basket chain conveyor 44 comprises a plurality of sections 50 made up of slats which are separated by the pairs of raised bars 42. The raised bars 42 are aligned with the lugs 34 of the tray carton conveyor 32 and function not only to retain the articles in place on the basket chain conveyor but also, as mentioned above, to retain the end flaps 24 and 26 in the open position. The end flaps 24 and 26 are held between the lugs 34 and raised bars 42 as the tray cartons pass through the loading station 6. Each section 50 of the conveyor 44 carries the articles to be deposited within one tray carton 12.

The articles to be packaged in the tray cartons 12 are loaded into the tray cartons by a pusher plate conveyor 52. The pusher plate conveyor 52 extends at an angle from the infeed conveyor 48, converges in the downstream direction toward the tray carton conveyor 32, and ends adjacent the tray carton conveyor 32. The pusher plate conveyor 52 includes a series of chain connected pusher plates 54 having article contact surfaces 56 extending parallel to the direction of travel of both the basket chain conveyor 44 and the tray carton conveyor 32. There are typically two pusher plates 54 for each section 50 of the basket chain conveyor. As the pusher plate conveyor 52 advances in the downstream direction each pair of pusher plates 54 contact the articles carried in the sections 50 and push them in a direction perpendicular to the direction of travel of both the basket chain conveyor 44 and the tray carton conveyor 32. In this manner the articles are pushed from each section 50 of the basket chain conveyor onto the bottom panel 14 of the tray carton 12 being carried by the tray carton conveyor 32 adjacent that particular basket chain conveyor section 50.

The partially erected tray cartons with the articles loaded therein are then conveyed by the tray carton conveyor 32 from the loading station 6 to the gluing and sealing station 8. There the erection of the tray is completed and the tray is sealed to complete the formation of the tray.

Figure 2:
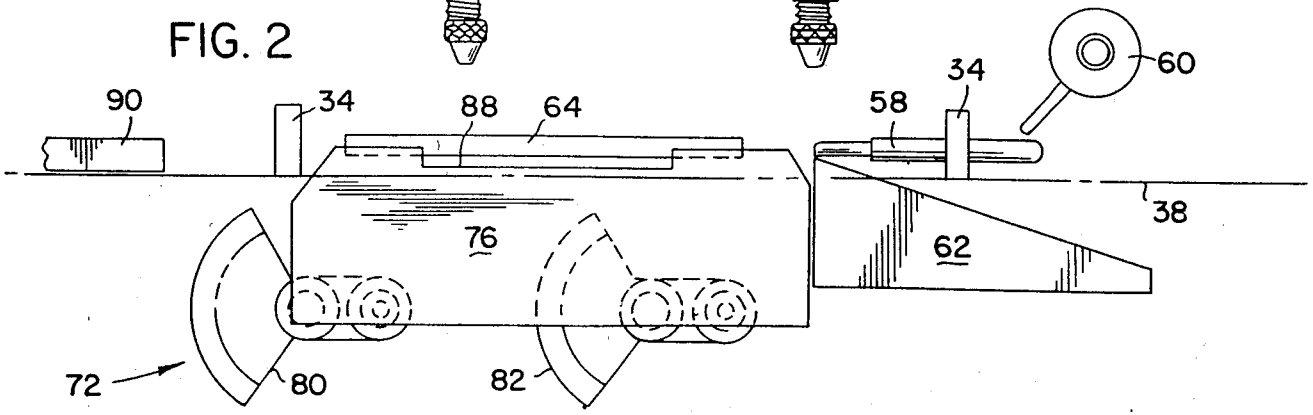
FIG. 2 is a cross-sectional elevation view in the gluing and sealing station illustrating the folding and sealing mechanism on the loading side of the machine with the folding plate in its upstream position at the beginning of a folding and sealing cycle.
Figure 3:
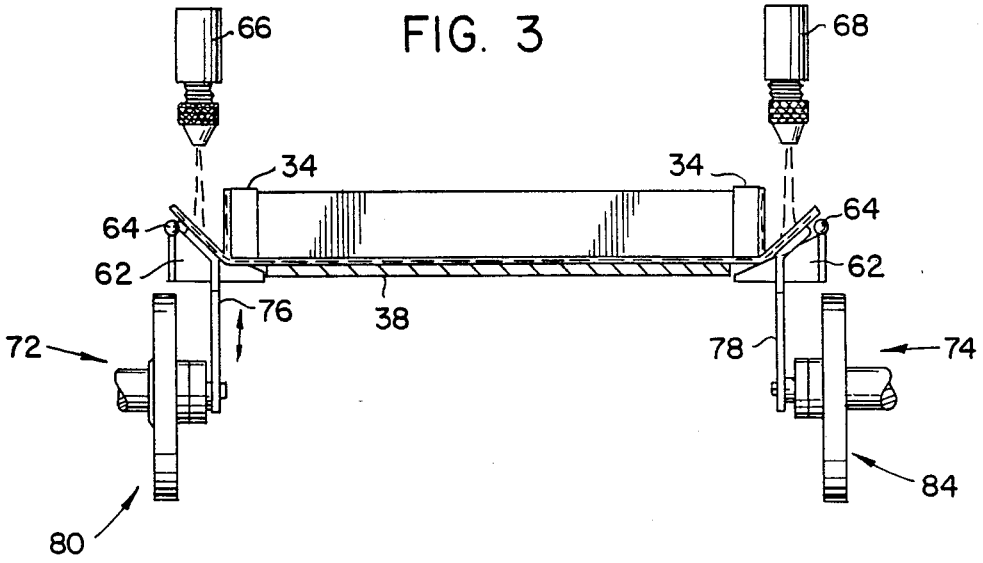
FIGS. 3 and 4 are cross-sectional views of the gluing and sealing station, looking upstream from the discharge station, at the beginning of the folding and sealing cycle and midway through the folding and sealing cycle respectively.
Figure 4:
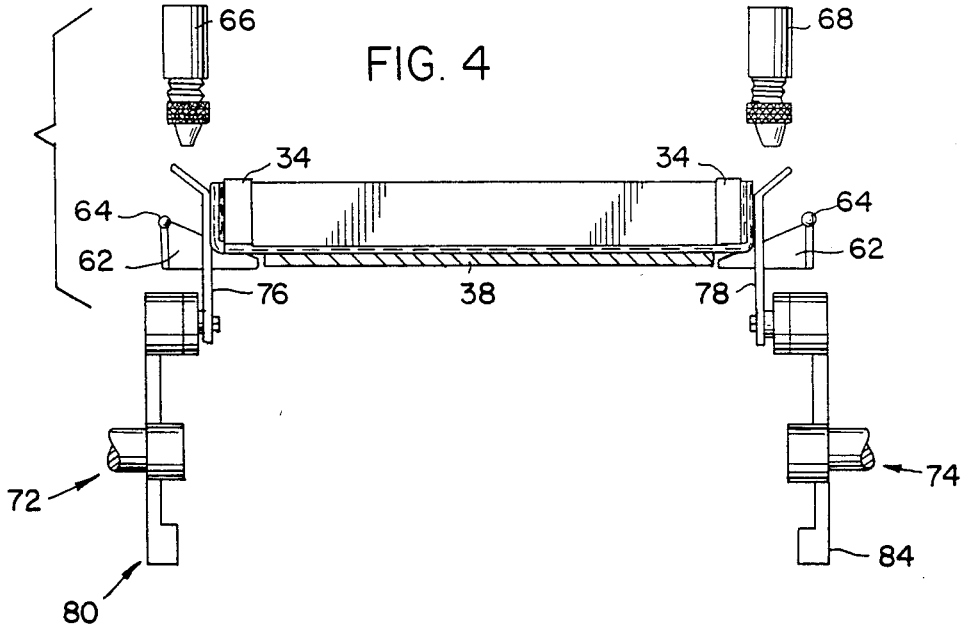

The gluing and sealing station 8 as best illustrated in FIGS. 2, 3 and 4, includes an end flap folding rod 58, an end flap tucking finger 60, a pair of end panel folding bars 62, a pair of end panel support rods 64, two pair of glue guns 66 and 68, an electronic eye 70 and a pair of end panel folding and sealing mechanisms 72 and 74.

The end flap folding rod 58 for folding the leading end flap 24 inward and retaining the leading end flap 24 in place is a static bar mounted just upstream of the end panel folding and sealing mechanism 72. The rod 58 is adjacent but not over the tray loading side of the bed plate 38. The height of the rod 58 above the horizontal plane of the bed plate 38 is equal to about one half of the height of the end flap 24. The rod 58 folds end flap 24 into the position illustrated in FIG. 10.

The end flap tucking finger 60 for folding the trailing end flap 26 inward is illustrated in FIGS. 1 and 2. The tucking finger 60 rotates clockwise and its rotation is synchronized with the movement of the tray carton conveyor 32 so that it folds the trailing end flap 26 in a downstream direction and holds the trailing end flap in place until the flap passes behind static rod 58 which retains it in place until the end panel 20 is folded upward. See FIG. 11.

The pair of end panel folding bars 62 are mounted directly across from each other just upstream from the end panel folding and sealing mechanisms 72 and 74 and adjacent the sides of the bed plate 38. The panel folding bars 62 are triangular in shape with upper surfaces that are inclined upwardly in the downstream direction. As the end panels 20 and 22 pass from beneath the fold down bars 40, the undersides of the end panels are engaged by the folding bars 62 and raised by the folding bars to an angle of about 20° to 30° above the horizontal. FIG. 11 illustrates the tray carton with the end panels partially raised by the folding bars as the leading ends of the end panels ride up on the folding bars.

Once the end panels 20 and 22 are raised by the folding bars 62, the panels pass downstream onto the end panel support rods 64 as the tray cartons are moved through the gluing and sealing station by the tray carton conveyor 32. The panel support rods 64 are mounted directly opposite each other on either side of the bed plate 38. The panel support rods 64 extend horizontally at a height above the plane of the bed plate 38 sufficient to support the panels at the angles set by the folding bars 62. The rods 64 are spaced laterally from the bed plate 38 distances sufficient to permit the folding plates 76 and 78 of the folding and sealing mechanisms to pass between the panel support rods 64 and the bed plate 38.

As shown in FIG. 1, the two pairs of glue guns 66 and 68 are mounted on either side of the bed plate 38 and are actuated by an electronic eye 70 to simultaneously apply glue to both end panels 20 and 22. The spacing between the glue guns of each pair is such that the beads of glue applied by the guns are located on the leading and trailing ends of the end panels 20 and 22 to coincide with the end flaps when the end panels are folded. Immediately after the glue beads are applied the end panels 20 and 22 are engaged by the end panel folding and sealing mechanisms 72 and 74 which complete the folding and sealing of the end panels. FIGS. 3 and 12 show the tray carton as the glue is being applied and prior to the contact between the end panels and the folding plates 76 and 78.

As shown in FIG. 1 the end panel folding and sealing mechanisms 72 and 74 are located on either side of and adjacent to the bed plate 38 just downstream from the panel folding bars 62 and just upstream from the discharge station 10. As illustrated in FIGS. 2–4 the end panel folding and sealing mechanisms 72 and 74 each includes a folding plate 76 and 78 respectively and a pair of cranks 80, 82 and 84, 86.

The folding plates 76 and 78 are about equal in length to the width of the tray cartons. The main portions of the folding plates 76 and 78 are vertical and flat. However, the upper ends of the folding plates 76 and 78 are inclined outwardly away from the bed plate so that the initial contact between the folding plates and the tray carton end panels 20 and 22 does not damage the end panels. The upper ends of the folding plates have cut out portions 88 as illustrated in FIG. 2, to provide clearance for the glue guns as the folding plates pass through the upper half of their cycles.

As shown in FIG. 2 the folding plate 76 is rotatably mounted adjacent its lower upstream and downstream ends to the crank arms of the cranks 80 and 82. As shown in FIG. 1, the folding plate 78 is rotatably mounted adjacent its lower downstream and upstream ends to crank arms of of the cranks 84 and 86. The crank arms of all of the cranks are of equal length and extend parallel to each other. The rotations of the cranks 80, 82, 84 and 86 are synchronized with each other so that the folding plates 76 and 78 move in unison. The cranks 80 and 82 of the folding and sealing mechanism 72 illustrated in FIG. 2 rotate in a counter clockwise direction. Of course the cranks 84 and 86 of the folding and sealing mechanism 74 opposite the mechanism illustrated in FIG. 2 rotate in a clockwise direction. While FIGS. 5 through 8 illustrate the folding and return cycle for folding and sealing mechanism 72 at 90° intervals, it is to be understood that the folding and sealing mechanism 74 would be in corresponding positions at the same intervals of its cycle.

Figure 5:
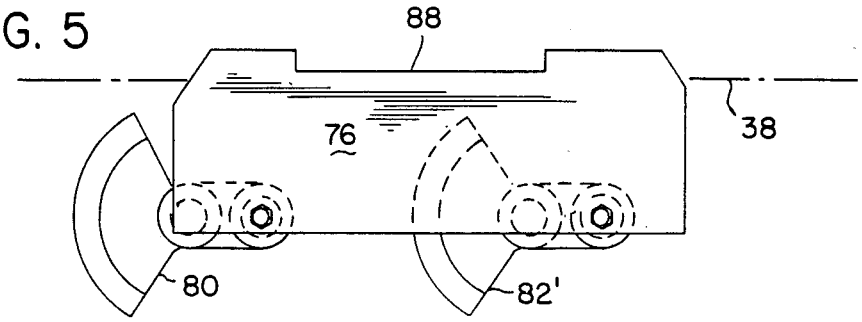
FIGS. 5–8 are views of the folding and sealing mechanism on the loading side of the machine illustrating the position of the folding plate at 90° intervals of rotation of the cranks.
Figure 6:
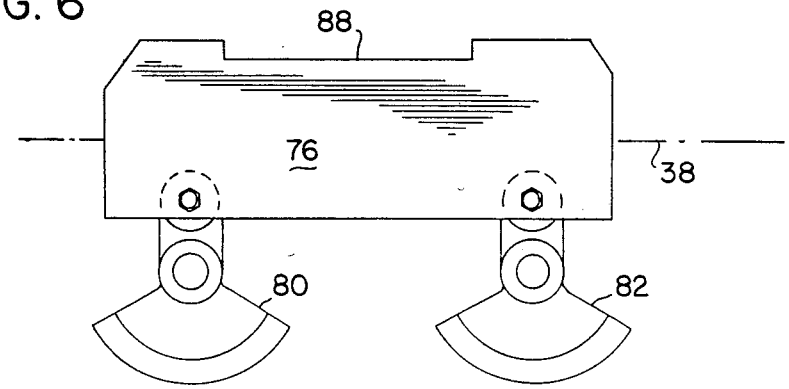
Figure 7:
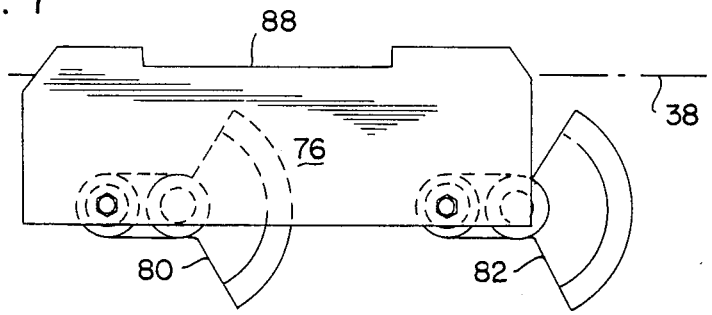
Figure 8:
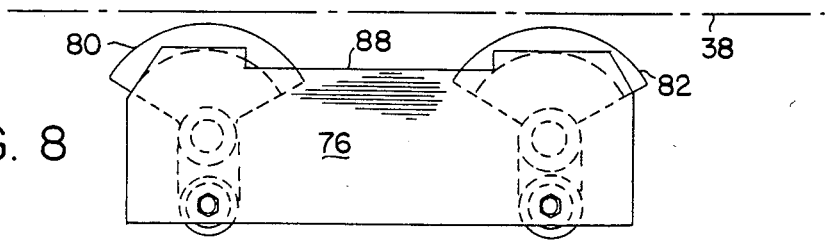

The rotations of the cranks 80, 82, 84 and 86 and accordingly the movements of folding plates 76 and 78 are also synchronized with the movement of the tray carton conveyor 32 so that the folding plates first contact the tray end panels 20 and 22 at the point of their cycles illustrated in FIGS. 2, 3 and 5. As the tray passes through the gluing and sealing station the folding plates 76 and 78 move upward and downstream. When the tray carton is midway through the gluing and sealing station 8 the folding plates 76 and 78 have moved to the uppermost part of their cycles as illustrated in FIGS. 4 and 6. As the leading part of the tray carton starts to pass between the compression bars 90 of the discharge station, the folding plates move from their uppermost position as illustrated in FIGS. 4 and 6 to their most downstream position as illustrated in FIG. 7. At the point the folding plates 76 and 78 reach their most downstream position the tray carton 12 is completely released from the folding plates and the end panels are only engaged by the compression bars 90 of the discharge station. FIG. 8 illustrates the location of the folding plates midway through the return or upstream portion of their cycles. In another 90° of movement the folding plates are again at the beginning of their folding cycle and about to engage the end panel of the next tray.

The compression bars 90 of the discharge station are mounted adjacent to the sides of but not over the bed plate 38. The compression bars extend from a height just above the bed plate to a height about equal to the height of the end panels. The compression bars are spaced from each other a distance such that the bars engage the end panels of the trays and retain pressure on the end panels. From the discharge station the trays with the articles therein are shipped or put into storage.

The operation of the folding and sealing station will now be described in detail.

After the tray cartons pass the loading station and before they are glued and sealed at the sealing station, the end flaps 24 and 26 on the loading side of the tray cartons 12 must be folded into position. As the end flaps 24 and 26 are released by the lugs 34 and raised bars 42 they spring outward. The leading end flap 24 is then contacted by the static flap folding rod 58 which folds the end flap 24 into place. The trailing end flap 26 is then folded into place by the rotating tucking finger 60 which holds the flap 26 in place until it passes behind the flap folding rod 58.

With the end flaps 24, 26, 28 and 30 in place, as the end panels 20 and 22 emerge from beneath the fold down bars 40 the panels are engaged by the upwardly inclined surfaces of the folding bars 62. The folding bars 62 raise the end panels slightly above the horizontal and the end panels pass onto and are supported by end panel support rods 64. Just before the end panels 20 and 22 are engaged by the folding plates 76 and 78, the glue guns 66 and 68 are actuated by the electronic eye 70 and deposit beads of glue at the leading and trailing ends of the end panels in alignment with the end flaps.

The end panels are then folded upward into place by the folding plates 76 and 78 which are moving in an upward and downstream direction as they make initial contact with the end panels. The folding plates as they pass through the upper half of their cycles not only fold the end panels 20 and 22 into position but press the end panels against the end flaps 24, 26, 28 and 30 as the glue at least partially sets. The articles in the tray provide a backing so that the end flaps and end panels are pressed together between the articles and the folding plates. As the folding plates pass through the last part of the upper portion of their cycle, the folding plates still move downstream but they also move downward releasing the tray cartons 12 to the compression bars 90 of the discharge station 10 which engage the leading portions of the tray cartons while the trailing portions of the tray cartons are still gripped between the folding plates. The glued and sealed tray, as illustrated in FIG. 13, is then ready for storage or shipment. The articles have been omitted from the drawings so that the operation of the machine and the formation of the tray carton could be better illustrated.

Having described the preferred embodiment of my invention in detail, what I desire to claim and protect by Letters Patent is:

1. In a machine for packaging articles in a tray carton having a central bottom panel, side panels hingedly joined to the bottom panel, end panels hingedly joined to the bottom panel and end flaps hingedly joined to the ends of the side panels, said machine including a tray carton conveyor for conveying the tray cartons downstream through the machine, means on an article loading side of the tray carton conveyor for folding the end flaps of the tray cartons on the loading side of the conveyor inward to extend toward each other, means disposed on either side of the tray carton conveyor for applying glue to the end panels of the tray cartons and means for folding the end panels against the end flaps and pressing the end panels and end flaps together to seal the tray cartons comprising a pair of end panel folding plates movably mounted directly opposite each other on either side of and adjacent the tray carton conveyor each said plate defining a planar lower surface and a contiguous upper surface flared outwardly and each said plate having a longitudinal dimension substantially equal to the dimension of one of the length and the width of the tray carton and means for moving said folding plates in unison upward and in a downstream direction to fold the end panels against the end flaps.

2. In a machine for packaging articles in a tray carton having a central bottom panel, side panels hingedly joined to the bottom panel, end panels hingedly joined to the bottom panel and end flaps hingedly joined to the ends of the side panels, said machine including a tray carton conveyor for conveying the tray cartons downstream through the machine, means on an article loading side of the tray carton conveyor for folding the end flaps of the tray cartons on the loading side of the conveyor inward to extend toward each other, means disposed on either side of the tray carton conveyor for applying glue to the end panels of the tray cartons and means for folding the end panels against the end flaps and pressing the end panels and end flaps together to seal the tray cartons comprising a pair of end panel folding plates movably mounted directly opposite each other on either side of and adjacent the tray carton conveyor and means for moving said folding plates in unison upward and in a downstream direction to fold end panels against the end flaps including first and second pairs of crank drives rotatably attached to the folding plates by crank arms, said crank drives having cycles of rotation which coincide whereby the crank arms rotate and the folding plates move in unison.

3. In a machine for packaging articles in a tray carton having a central bottom panel, side panels hingedly joined to the bottom panel, end panels hingedly joined to the bottom panel and end flaps hingedly joined to the ends of the side panels, said machine including a tray carton conveyor for conveying the tray cartons downstream through the machine, means on an article loading side of the tray carton conveyors for folding the end flaps of the tray cartons on the loading side of the conveyor inward to extend toward each other, means disposed on either side of the tray carton conveyor for applying glue to the end panels of the tray cartons and means for folding the end panels against the end flaps and pressing the end panels and end flaps together to seal the tray cartons comprising a pair of end panel folding plates movably mounted directly opposite each other on either side of and adjacent the tray carton conveyor and means for moving said folding plates in unison upward and in a downstream direction to fold the end panels against the end flaps including first and second pairs of crank drives rotatably attached to the folding plates by crank arms, said crank drives having cycles of rotation which coincide whereby the crank arms rotate, the folding plates move in unison and a pair of static folding bars are mounted adjacent but upstream from the folding plates, said folding bars are mounted directly opposite each other on either side of and adjacent the tray carton conveyor, and said folding bars have upper surfaces which are inclined upwardly in the downstream direction to start the upward folding of the end panels prior to contact between the end panels and the folding plates.

4. In a machine for packaging articles in a tray carton having a central bottom panel, side panels hingedly joined to the bottom panel, end panels hingedly joined to the bottom panel and end flaps hingedly joined to the ends of the side panels, said machine including a tray carton conveyor for conveying the tray cartons downstream through the machine, means on an article loading side of the tray carton conveyor for folding the end flaps of the tray cartons on the loading side of the conveyor inward to extend toward each other, means disposed on either side of the tray carton conveyor for applying glue to the end panels of the tray cartons and means for folding the end panels against the end flaps and pressing the end panels and end flaps together to seal the tray cartons comprising a pair of end panel folding plates movably mounted directly opposite each other on either side of and adjacent the tray carton conveyor and means for moving said folding plates in unison upward and in a downstream direction to fold the end panels against the end flaps including first and second pairs of crank drives rotatably attached to the folding plates by crank arms, said crank drives having cycles of rotation which coincide whereby the crank arms rotate and the folding plates move in unison, said crank drives under a normal shut-down stop with the folding plates in their upper position thereby completing the folding and sealing operation for the tray carton being sealed.

* * * * *